United States Patent [19]

Yukumoto et al.

[11] Patent Number: 4,951,736

[45] Date of Patent: Aug. 28, 1990

[54] COOLING ROLL FOR PRODUCING QUENCHED THIN METAL TAPE

[75] Inventors: Masao Yukumoto; Michiharu Ozawa; Takahiro Kan, all of Chiba, Japan

[73] Assignee: Kawasaki Steel Corporation, Hyogo, Japan

[21] Appl. No.: 379,680

[22] Filed: Jul. 12, 1989

Related U.S. Application Data

[63] Continuation of Ser. No. 228,243, Aug. 4, 1988, abandoned.

[30] Foreign Application Priority Data

Dec. 17, 1987 [JP] Japan ..... 62-317313

[51] Int. Cl.[5] ..... B22D 11/06

[52] U.S. Cl. ..... 164/428; 164/138

[58] Field of Search ..... 164/138, 423, 427, 428, 164/429, 463, 479, 480

[56] References Cited

U.S. PATENT DOCUMENTS

| | | | |
|---|---|---|---|
| 4,142,571 | 3/1979 | Narasimhan | 164/463 |

FOREIGN PATENT DOCUMENTS

| | | | |
|---|---|---|---|
| 1160423 | 1/1984 | Canada | 164/138 |
| 55-165261 | 12/1980 | Japan | 164/138 |
| 59-73153 | 4/1984 | Japan | 164/138 |
| 59-163056 | 9/1984 | Japan | 164/423 |
| 61-159247 | 7/1986 | Japan | 164/138 |

*Primary Examiner*—Richard K. Seidel

*Attorney, Agent, or Firm*—Dvorak and Traub

[57] ABSTRACT

A cooling roll for producing quenched thin metal tape from molten metal by the twin-roll method. The roll is made of copper or copper alloy, and the roll surface is covered with a first layer of nickel plating 0.2 to 0.6 mm thick and a second layer of chromium plating 0.02 to 0.05 mm thick. The roll has the surface which does not suffer from deformation, seizure, winding, roughening, wear, and cracking. Thus the roll can produce quenched thin metal tape with a smooth surface in a stable manner for a long time.

4 Claims, 4 Drawing Sheets

COOLING ROLL FOR PRODUCING QUENCHED THIN METAL TAPE

Cross Reference:

This is a continuation-in-part application from a copending U.S. Patent application Ser. No. 228,243 filed Aug. 4, 1988, now abandoned.

BACKGROUND OF THE INVENTION

1. Field of the Invention:

The present invention relates to a cooling roll suitable for use in the process of producing thin metal tape directly from a molten metal by the twin-roll method or single-roll method.

2. Description of the Prior Art:

There is a known method of producing thin metal tape directly from a molten metal. According to this method, a molten metal is allowed to jet from a nozzle and the jet is brought into contact with the surface of a roll running at a high speed for cooling and solidification. This method is classified into the single-roll method and twin-roll method according to the number of rolls used.

The roll for producing quenched thin metal tape is made of high speed steel or sintered hard alloy as disclosed in, for example, Japanese Patent Laid-open No. 119650/1981. The conventional roll, however, has a disadvantage that it cannot be used for long-time operation, because when the roll surface gets hotter than 600° C. in the production of thin metal tape thinner than several millimeters, the thin metal tape may stick around the roll or seize to the roll surface, or cracking may occur on the surface of the roll.

For instance, in a crystalline strip such as a high silicon steel strip of 500 mm width, heat capacity ΔH to be cooled, including sensible and latent heat, amounts to 350,000 cal/sec, which is estimetated as so times as large as compared to that of an amorphous metal strip.

The heat value ΔH can be calculated by the following equation.

$$\Delta H=\{\rho.C.)(T_m-T_s)+\alpha.\rho\}.W.d.v$$

where:

ΔH: heat value
$\rho$: density
C : specific heat
$T_m$: melting point
$T_s$: solidified temperature
$\alpha$: latent heat
W : width
d : thickness
v : roll velocity And it is noted that ΔH for an amorphous metal lacks $\alpha.\rho$ in the above equation and on the other hand ΔH for a crystalline metal includes $\alpha.\rho$ which is 10 times or more larger than $\rho.C.(T_m-T_s)$.

To eliminate this disadvantage, there was proposed in Japanese Patent Laid-open No. 77918/1982 a quenching roll made of copper alloy such as Cu-Zr or Cu-Be having a high thermal conductivity and high strength. This roll is in general use at present.

However, the roll of copper alloy still suffers from the disadvantage of being subject to hair-cracking or microcracking in the continuous production of thin metal tape thinner than several millimeters by the twin-roll method. This trouble may occur when the operation is continued to process a molten metal in excess of 500 kg. The hair-cracked roll causes the molten metal to penetrate into the cracking resulting to stick around the roll, which leads to the unavoidable discontinuance of operation owing to breakout and so on.

In order to solve this problem, the present inventors proposed in Japanese Patent Laid-open No. 116956/1983 a cooling roll for producing quenched thin metal tape of high silicon steel, said roll having a coating layer of nickel plating or nickel alloy plating. This cooling roll is superior in wear resistance and is immune to the seizure of thin metal tape. Nevertheless, it is still subject to hair-cracking when it cools a large amount of molten metal continuously.

The surface coating of the cooling roll is not necessarily effective, depending on the material of surface coating and the conditions of operation, in preventing the seizure or sticking of thin metal tape in the production of thin metal tape thinner than 1 mm, with the cooling roll running at a high peripheral speed. This is particularly true of iron rolls and some copper alloy rolls having a low thermal conductivity, because the sensible and latent heat to be removed may be estimated too large for such rolls.

On the other hand, copper alloy, rolls having a high thermal conductivity decrease in hardness at high temperatures and hence wear and/or roughen after operation for a long time.

In the meantime, rolls for the twin-roll method are liable to deformation at high temperatures (500° C. or above) because the two rolls are pressed against each other to perform rolling. Deformation takes place at the part where the two rolls come into contact with each other. The deformed rolls fluctuate the thickness of the thin metal tape and roughens the surface of the thin metal tape.

To prevent the seizure or sticking of thin metal tape, the roughening and wear of roll surface, the deformation of roll, the fluctuation of metal tape thickness, and the roughening of metal tape surface, there was developed a cooling roll of copper alloy having a high thermal conductivity and a high strength at high temperatures. Even this cooling roll is subject to intercrystalline cracking (or hair cracking) resulting from the thermal fatigue at high temperatures under high pressures, if the copper alloy is of precipitation hardening type (such as Cu-Be, Cu-Zr-Cr). Therefore, this cooling roll does not withstand continuous operation for a long time.

SUMMARY OF THE INVENTION

It is an object of the present invention to provide a cooling roll for producing quenched thin metal tape without causing the thin metal tape to seize to the roll surface or wind around the roll.

It is another object of the present invention to provide a cooling roll for producing quenched thin metal tape, said roll having a roll surface which maintains a high hardness at high temperatures and does not roughen or wear.

It is further another object of the present invention to provide a roll which is not liable to deformation at high temperatures.

It is still further another object of the present invention to provide a cooling roll for producing quenched thin metal tape, said roll being resistant to thermal fatigue and capable of continuous operation for a long time.

In order to achieve the above-mentioned objectives, the present inventors carried out a series of researches, which led to the finding that the objectives are achieved with a cooling roll made of copper or copper alloy, with the surface thereof coated with the layers of nickel plating or nickel alloy plating and chromiun plating formed thereover.

The present invention was made on the basis of this finding. Accordingly, the present invention provides a cooling roll for producing quenched crystallized thin metal tape by absorbing sensible heat as well as latent heat and solidifying a downward flow of molten metal having high melting point and crystallization property, said cooling roll comprising a first layer of nickels plating 0.2 to 0.6 mm thick and a second layer of chromium plating 0.02 to 0.05 mm thick formed on the surface of a roll body made of copper or copper alloy.

DESCRIPTION OF PREFERRED EMBODIMENTS

The present invention was made after a series of experiments mentioned below which were conducted to find out the best mode of carrying out the present invention.

There is an industrial method called direct rolling for producing thin crystallized metal tape directly from molten carbon steel, stainless steel, silicon steel, nickel-base alloy, or cobalt-base alloy, which has high melting point and crystallization property. The direct rolling is accomplished by the twin-roll method.

It is known that the twin-roll method has advantages to get fine crystal and less segregation by raising higher heat removing capacity so that it promotes production of thinner tape, resulting more stable solidification and quicker quenching.

Figure 1:
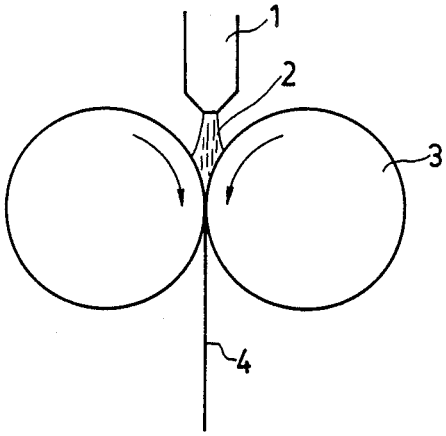
FIG. 1 is a schematic diagram illustrating the steps of producing quenched thin metal tape by the twin-roll method.

According to the twin-roll method, the molten metal is poured into the gap between the two rolls as shown in FIG. 1. The molten metal is caught by the two rolls for simultaneous cooling and rolling. The cooling roll, therefore, is required to have high strength, toughness, and hardness so that it has a precision surface. In FIG. 1, there are shown the molten metal nozzle 1, the molten metal 2, and the cooling roll 3. The twin-roll method is effective in removing heat, solidifying the molten metal in a stable manner, making the molten metal into thin metal tape rapidly, forming fine crystals on account of rapid cooling, and reducing the segregation. The rolls used for the twin-roll method are made of iron-based materials such as high speed steel, stainless steel, and dies steel, or copper-based materials such as pure copper, beryllium-copper alloy, and chromium-copper alloy, so that they have good resistance to surface roughening, cracking , and corrosion.

Figure 2:
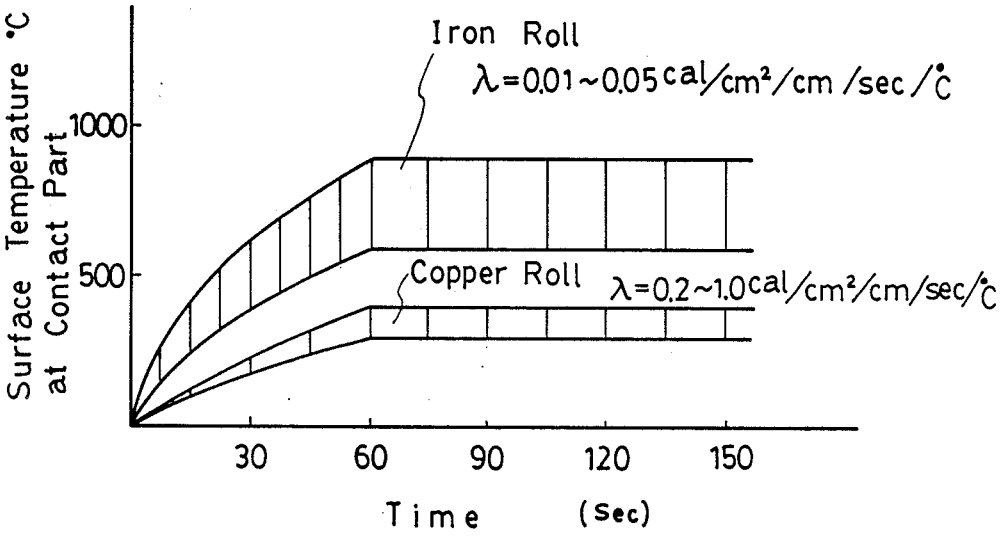
FIG. 2 is a graph showing the change with a lapse of time of the surface temperature at the contacting part of iron cooling rolls and copper cooling rolls.

In the case of rolls used for the production of thin metal tape (1mm or less in thickness), the maximum surface temperature at the contact part of two rolls varies depending on the heat removing efficiency or the thermal conductivity of the roll material as shown in FIG. 2. For example, in the case of iron rolls (having a coefficient or thermal conductivity of $=0.01$–$0.05$ cal /cm$^2$/cm/sec/° C.), the surface temperature at the contact part is 600–900° C. as shown in FIG. 2. In the present inventors' experiments, it was found that the molten metal sticks around the roll when the surface temperature at the contact part exceeds 600° C. and the roll material changes in quality when the surface temperature at the contact part is about 900° C. This leads to the formation of a reaction layer on the interface and the seizure of molten metal to the roll. Therefore, iron rolls are not suitable for the direct rolling of thin metal tape. In addition, iron rolls yield thin metal tape containing unsolidified parts which is liable to break.

By contrast, in the case of copper rolls or copper alloy rolls (having a coefficient of thermal conductivity of $=0.2$–$1.0$ cal/cm$^2$/cm/sec/° C.), the surface temperature at the contact part is 300–400° C. Therefore, they do not cause the sticking, seizure, or breakout of the thin metal tape. Incidentally, the rolls used in the experiments are of internal water cooling type having a 5–20 mm thick sleeve.

It is understood from the foregoing that copper rolls or copper alloy rolls are suitable for the twin-roll method for producing thin metal tape of 1 mm or less in thickness as in the present invention. The copper rolls or copper alloy rolls, however, suffer from a disadvantage that their surface roughens after continuous use for a long time. The rolls with a rough surface yield thin metal tape having irregular surface and thickness fluctuation. In the worst case, the rolls become unusable on account of surface cracking.

In order to solve this problem, the present inventors studied various surface coating technologies. It was found by the method of trial and error that the most suitable cooling roll is obtained by forming a first layer of nickel plating 0.2 to 0.6 mm thick and a second layer of chromium plating 0.02 to 0.05 mm thick on the surface of the copper roll or copper alloy roll.

The desired coating material for the cooling roll is nickel plating which has a coefficient of thermal expansion of $14-15\times10^{-6}$ (1/° C.) which is close to that of copper or copper alloy (as the base metal) which is $16-7\times10^{-6}$ (1/° C.).

Unfortunately, the twin-roll method is subject to the sticking of thin metal tape, and the nickel plating alone is not enough to prevent this trouble. The object is achieved only when the layer of nickel plating is covered with chromium plating. The nickel plating interposed between the copper (base metal) and the chromium plating relieves the stress resulting from their difference in thermal expansion and also prevents the peeling of the chromium plating.

Figure 3:
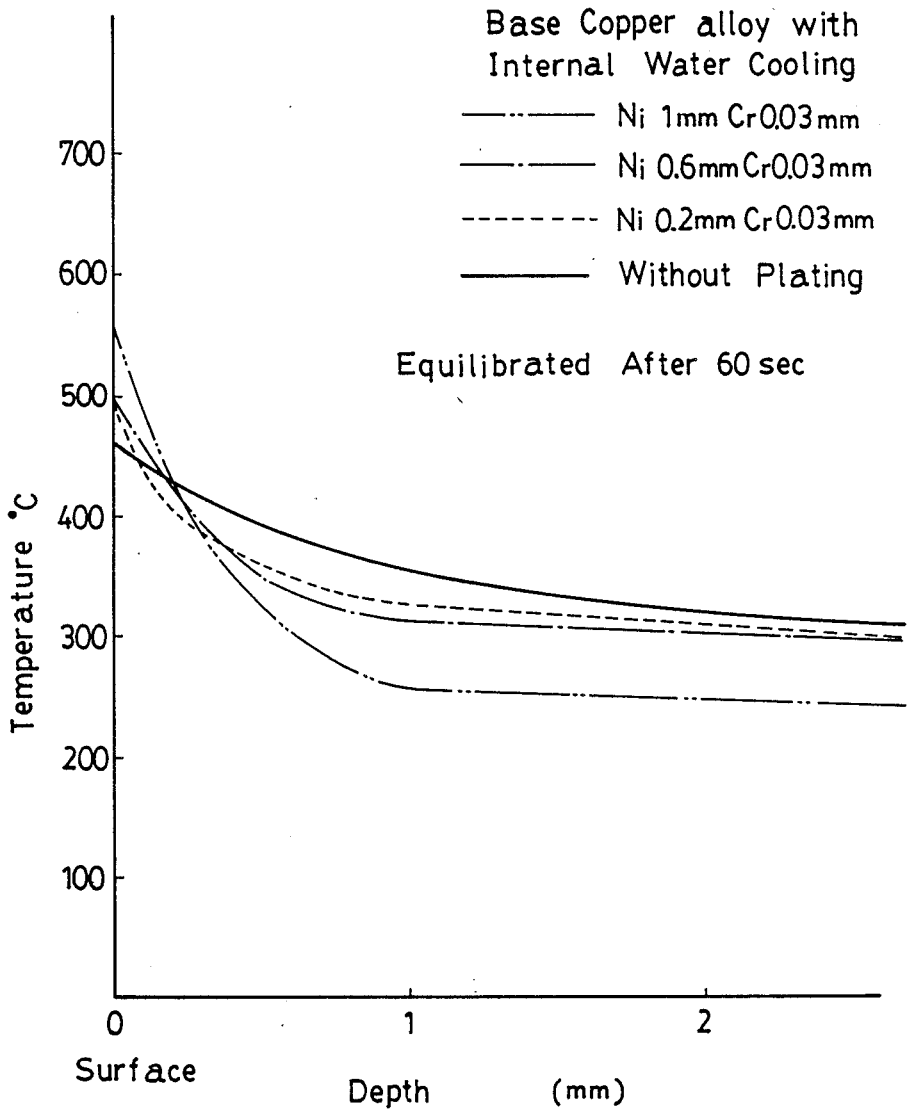
FIG. 3 is a graph showing the effect of the plating layer on the temperature distribution in the radial direction of the cooling roll.

The layer of nickel plating and chromium plating should have the above-specified thickness for reasons given below. The temperature distribution in the roll radial direction at the contacting part of the rolls was measured for internally water-cooled copper alloy rolls with nickel plating and chromium plating of different thicknesses. The measurements were carried out at the 60th rotation of the roll (or when the steady state was reached) in the production of quenched thin metal tape. The results are shown in FIG. 3.

Figure 4:
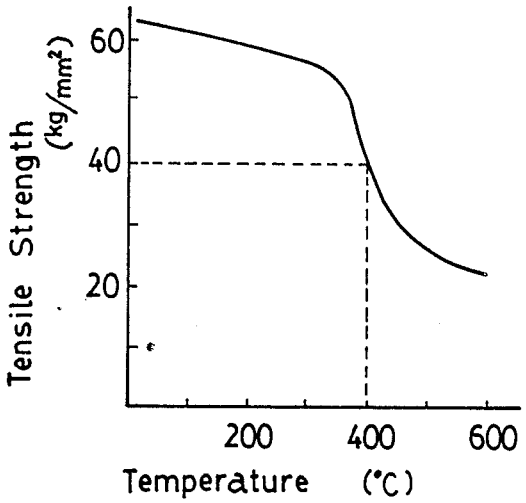
FIG. 4 is a graph showing the strength of a Cu-Be alloy at high temperatures.
Figure 5:
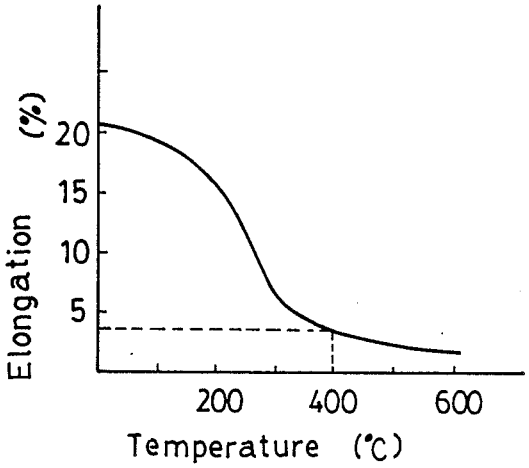
FIG. 5 is a graph showing the elongation of a Cu-Be alloy at high temperatures.

In the case of a copper alloy roll without Ni-Cr plating, the surface temperature at the contacting part reaches 450° C. At temperatures above 400° C., the Cu-Be alloy extremely decrease in strength and elongation as shown in FIGS. 4 and 5. Therefore, copper alloy rolls made of, for example, Cu-Be, Cu-Cr, or Cu-Zr-Cr, undergo thermal fatigue, with the surface suffering from microcracking, after continuous use for a long time.

Figure 6:
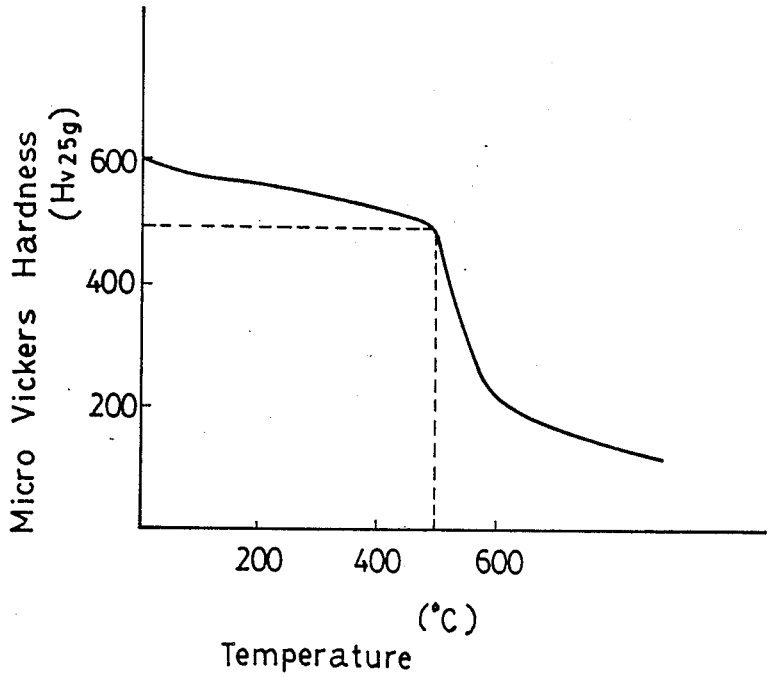
FIG. 6 is a graph showing the hardness of the chromium layer at high temperatures.

If the layer (0.2–0.6 mm thick) of nickel plating is covered with a layer of chromium plating, the surface temperature of the roll does not reach 500° C. The outer layer of chromium plating has a Vickers hardness (Hv25g) of 500 or above even when the contacting part is at the maximum temperature, as shown in FIG. 6. Thus the roll surface is resistant to roughening. In addition, the layer of chromium plating keeps the temperature below 400° C. at the interface between the copper alloy base metal and the plating layer. Therefore, the roll with dual layers of plating is immune to the extreme deteriotation of tensile and elongation properties.

As mentioned above, the layer of nickel plating should be at least 0.02 mm thick in order that the surface temperature at the contacting part is kept below 500° C. and the temperature at the interface between the plating layer and the copper alloy base metal is kept below 400° C. According to the present invention, the layer of nickel plating should be at least 0.02 mm thick. On the other hand, with an excessively large thickness, the layer of nickel plating raises the roll surface temperature as indicated by the chain line in FIG. 3. Therefore, according to the present invention, the layer of nickel plating should be 0.6 mm at the maximum.

The second layer i.e., the layer of chromium plating on the roll surface should desirably be as thin as possible, so that it is not subject to internal cracking during rolling. Therefore, according to the present invention, the layer of chromium plating should be 0.05 mm thick at the maximum. The minimum thickness should be 0.02 mm so that the layer of chromium plating is capable of polishing after plating.

In addition, the layer chromium plating should have a micro Vickers hardness (Hv25g) of 600–900, because the occurrence of internal cracking is related with the hardness of the layer of chromium plating.

EXAMPLE

A quenched thin metal tape measuring 0.5–0.6 mm thick and 500 mm wide was produced by the twin-roll method under the following conditions. The material of the roll sleeve and the plating on the roll surface are shown in Tables 1A, 2A and 3A. The roll is of internal water cooling type.

| | |
|---|---|
| Type of steel: | 4.5% Si—Fe |
| Cooling roll: | Outside diameter: 550 mm<br>Width: 500 mm<br>Sleeve thickness: 5 mm |
| Roll rotation speed: | 3 m/s |
| Tapping temperature: | 1600° C. |
| Amount of molten metal: | 3 tons |

After the production of quenched thin metal tape, the surface of the rolls was examined. The results are shown in Tables 1B, 2B and 3B respectively corresponding to Tables 1A, 2A and 3A.

It is noted from Table 1 that the cooling roll pertaining to the present invention wears only a little and is immune to sticking, seizure, and cracking. By contrast, some troubles or other occurred in Comparative Examples in which the roll sleeve is not made of copper alloy or the roll sleeve of copper alloy is covered with a layer of plating which is outside the scope of the present invention.

As mentioned above, the cooling roll pertaining to the present invention keeps its surface free of deformation, seizure or winding, roughening, wear, and cracking when it is used for the production of quenched thin metal tape. Therefore, it can produce quenched thin metal tape with a smooth surface in a stable manner for a long time.

TABLE 1-A

| No. | Sleeve material | Coating layer first layer (thickness, mm) | Coating layer 2nd layer (thickness, mm) |
|---|---|---|---|
| Example 1 | Cu | Ni plating (0.6 mm) | Cr plating (0.03 mm) |
| Example 2 | Cu—Cr | Ni plating (0.4 mm) | Cr plating (0.02 mm) |
| Example 3 | Cu—Be | Ni plating (0.2 mm) | Cr plating (0.05 mm) |
| Example 4 | Cu—Zr—Cr | Ni plating (0.4 mm) | Cr plating (0.03 mm) |

TABLE 1-B

| No. | 2nd layer hardness (Hv 25 g) | Roll surface roughness Ra (μm) | State of crack | Feature of plate surface |
|---|---|---|---|---|
| Example 1 | 900 | 0.2 | none | good at Ra 1.0 or less |
| Example 2 | 600 | 0.4 | none | good at Ra 1.0 or less |
| Example 3 | 800 | 0.2 | none | good at Ra 1.0 or less |
| Example 4 | 900 | 0.3 | none | good at Ra 1.0 or less |

TABLE 2-A

| No. | Sleeve material | Coating layer first layer (thickness, mm) | Coating layer 2nd layer (thickness, mm) |
|---|---|---|---|
| Comparative Example 5 | S45C | — | — |
| Comparative Example 6 | SKD | — | Cr plating (0.03 mm) |
| Comparative Example 7 | SKH | Ni plating (0.2 mm) | Cr plating (0.02 mm) |
| Comparative Example 8 | Cu—Be | — | — |
| Comparative Example 9 | Cu—Cr | — | — |
| Comparative Example 10 | Cu | — | Cr plating (0.05 mm) |
| Comparative Example 11 | Cu—Be | Ni plating (0.1 mm) | Cr plating (0.03 mm) |

TABLE 2-B

| No. | 2nd layer hardness (Hv 25 g) | Roll surface roughness Ra (μm) | State of crack | Feature of plate surface |
|---|---|---|---|---|
| Comparative Example 5 | — | 4.0 | seized | broken out |
| Comparative Example 6 | 1000 | 3.5 | seized | broken out |
| Comparative Example 7 | 800 | 3.0 | seized | broken out |
| Comparative Example 8 | — | 1.5 | many cracks taking place in grain boundary, work stop at 500 kg heat size | Cracks, transferred at Ra 2.0 μm |
| Comparative Example 9 | — | 2.0 | microcracking, roll deformation | Ra, 3.0 μm or more, rugged plate surface |
| Comparative Example 10 | 1000 | 2.5 | Plating, peeled off, cracks, generated | Ra, 3.0 μm or more, rugged plate surface |
| Comparative Example 11 | 900 | 1.0 | Plating, peeled off, cracks, generated | Cracks, transferred at Ra 2.0 μm |

TABLE 3-A

| No. | Sleeve material | Coating layer first layer (thickness, mm) | Coating layer 2nd layer (thickness, mm) |
|---|---|---|---|
| Comparative Example 12 | Cu | Ni plating (1.0 mm) | Cr plating (0.05 mm) |
| Comparative Example 13 | Cu—Zr—Cr | Ni plating (0.6 mm) | Cr plating (0.05 mm) |
| Comparative Example 14 | Cu—Be | WC frame spraying (0.2 mm) | — |
| Comparative Example 15 | Cu | Tin PVD (0.005 mm) | — |
| Comparative Example 16 | Cu—Be | Ni plating (0.6 mm) | Cr plating (0.03 mm) |

TABLE 3-B

| No. | 2nd layer hardness (Hv 25 g) | Roll surface roughness Ra (μm) | State of crack | Feature of plate surface |
|---|---|---|---|---|
| Comparative Example 12 | 800 | 2.0 | microcracking, rugged surface | Poor feature at Ra 3.0 μm |
| Comparative Example 13 | 1200 | 0.4 | Plating, peeled off, cracks, generated | Poor feature at Ra 2.0 μm |
| Comparative Example 14 | — | 0.3 | frame sprayed area, peeled off | Poor feature at Ra 2.0 μm |
| Comparative Example 15 | — | 1.0 | Coating, peeled off | Poor feature at Ra 2.0 μm |
| Comparative Example 16 | 500 | 3.0 | Cr plating, softened, severely rugged surface, microcracking, present | Poor feature of plate at Ra 3.0 μm or more |

What is claimed is:

1. In a twin roll casting system, a cooling roll for producing quenched crystallized thin metal tape by absorbing sensible heat as well as latent heat and solidifying a downward flow of molten metal having high melting point and crystallization property, said cooling roll comprising a first layer of nickel plating 0.2 to 0.6 mm thick and a second layer of chromium plating 0.02 to 0.05 mm thick formed on the surface of a roll body made of copper alloy.

2. A cooling roll as claimed in claim 1, wherein the layer of chromium plating has a micro Vickers hardness (Hv25g) of 600 to 900.

3. In a twin roll casting system, a cooling roll for producing quenched crystallized thin metal tape by absorbing sensible heat as well as latent heat and solidifying a downward flow of molten metal having a high melting point and crystallization property, said cooling roll comprising a first layer of nickel plating 0.2 to 0.6 mm thick and a second layer of chromium plating 0.02 to 0.05 mm thick formed on the surface of a roll body made of copper alloy.

4. A cooling roll as claimed in claim 1, wherein the layer of chromium plating has a micro Vickers hardness (Hv25g) of 600 to 900.

* * * * *